US006589067B1

(12) United States Patent
Kolton et al.

(10) Patent No.: US 6,589,067 B1
(45) Date of Patent: Jul. 8, 2003

(54) ARTICLE SURVEILLANCE UNIT AND ASSEMBLIES THEREWITH

(75) Inventors: Chester Kolton, Westfield, NJ (US); Michael Norman, East Brunswick, NJ (US); Robert Whittemore, Middletown, NY (US)

(73) Assignee: B&G Plastics, Inc., Newark, NJ (US)

( * ) Notice: Subject to any disclaimer, the term of this patent is extended or adjusted under 35 U.S.C. 154(b) by 0 days.

(21) Appl. No.: 10/217,091

(22) Filed: Aug. 12, 2002

Related U.S. Application Data

(63) Continuation of application No. 10/093,597, filed on Mar. 8, 2002, now Pat. No. 6,488,531.

(51) Int. Cl.[7] ..... H01R 3/00; G08B 13/14

(52) U.S. Cl. ..... 439/491; 439/488; 340/572.8; 340/572.9; 340/568.3; 340/568.4

(58) Field of Search ..... 340/572.8, 572.9, 340/568.3, 568.4; 439/491, 488

(56) References Cited

U.S. PATENT DOCUMENTS

| | | | | |
|---|---|---|---|---|
| 5,334,044 A | * | 8/1994 | Falossi et al. | 439/491 |
| 5,347,113 A | * | 9/1994 | Reddersen et al. | 439/491 |
| 5,620,335 A | * | 4/1997 | Siemon | 439/491 |
| 5,714,936 A | * | 2/1998 | Regelsberger | |
| 5,988,462 A | | 11/1999 | Kolton | |
| 6,304,184 B1 | * | 10/2001 | Kolton et al. | |
| 6,339,378 B2 | * | 1/2002 | Seidel | |

* cited by examiner

*Primary Examiner*—Gary Paumen
(74) *Attorney, Agent, or Firm*—Robin, Blecker & Daley

(57) ABSTRACT

An electrical cable assembly including an electrical cable and an electrical connector connected to the electrical cable has a housing thereon defining a passage therethrough for the electrical cable and opposed housing ends circumscribing the cable, one of the housing ends being in facing relation to the electrical connector. The housing has an EAS member secured therein aside the housing passage. An article surveillance unit has first and second housing members joined to one another and defining a seam line, one of the first and second housing members defining structure overlapping the seam line.

12 Claims, 2 Drawing Sheets

ARTICLE SURVEILLANCE UNIT AND ASSEMBLIES THEREWITH

Cross Reference to Related Applications

This application is a continuation of application Ser. No. 10/093,597, filed Mar. 8, 2002 now U.S. Pat. No. 6,488,531.

FIELD OF THE INVENTION

This invention relates generally to security from shoplifting of articles of manufacture and pertains more particularly to electronic article surveillance (EAS) marker assemblies for use with articles of manufacture.

BACKGROUND OF THE INVENTION

One form of electronic article surveillance (EAS) marker in widespread use is in the form of a flat, thin, flexible, rectangular member which is applied adhesively to flat or curved exterior surfaces of articles. One shortcoming of such exterior surface application is that, while often covered by a bar code label, the presence of the EAS marker nonetheless is evident since it is visible from the sides of the bar code label. Still further, the EAS marker is accessible to a customer.

In commonly-assigned U.S. Pat. No. 5,998,462, a garment hanger is disclosed which overcomes the foregoing disadvantages. Therein, a garment hanger is set forth which is comprised of a one-piece body having a hook portion for the receipt of a display rod, a central portion depending from the hook portion and a lower portion for engagement with an article to be displayed. The central portion defines a recess opening into an exterior surface of the central portion, the recess being of dimensions suited for residence of an EAS marker in the hanger. A bar code label or like recess closure member is affixed to the central portion exterior surface in contiguous overlying relation therewith and enclosing the resident EAS marker.

Other solutions to the above-noted problem provide for the EAS marker to be contained in a housings securable to articles of manufacture, wherein the housings render the EAS marker not viewable.

SUMMARY OF THE INVENTION

The present invention has as its primary object the provision of improved EAS marker application to articles of manufacture.

A more particular object of the invention is to provide improved EAS marker application to electrical cable assemblies.

A further object of the invention is to provide improved article surveillance units.

In attaining the foregoing objects, in one aspect the invention provides, in combination an electrical cable assembly including an electrical cable and an electrical connector connected to the electrical cable and a housing defining a passage therethrough for the electrical cable and opposed housing ends circumscribing the cable, one of the housing ends being in facing relation to the electrical connector, the housing having an EAS member secured therein aside the housing passage.

In another aspect, the invention provides an article surveillance unit comprising first and second housing members joined to one another and defining a seam line, one of the first and second housing members defining structure overlapping the seam line.

The foregoing and other objects and features of the invention will be further evident from the following detailed description of preferred embodiments thereof and from the drawings in which like components are identified by like reference numerals throughout.

DETAILED DESCRIPTION OF PREFERRED EMBODIMENTS AND PRACTICES

Figure 2:
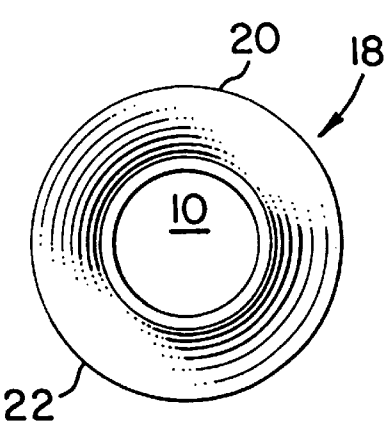
FIG. 2 is a right side elevation of FIG. 1.
Figure 1:
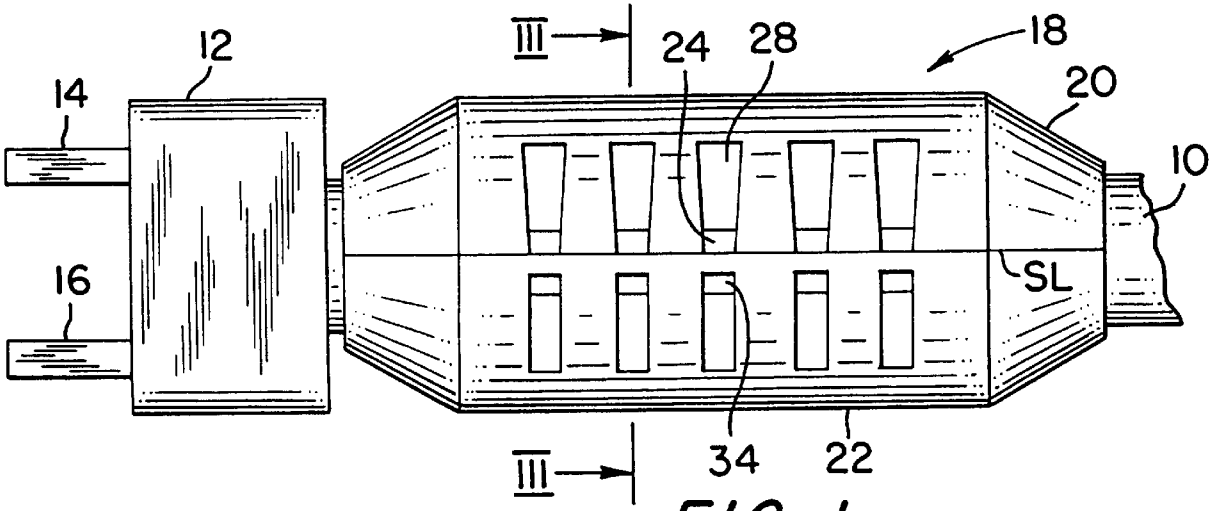
FIG. 1 is a front elevation of an electrical cable assembly and an article surveillance unit in accordance with the invention.
Figure 3:
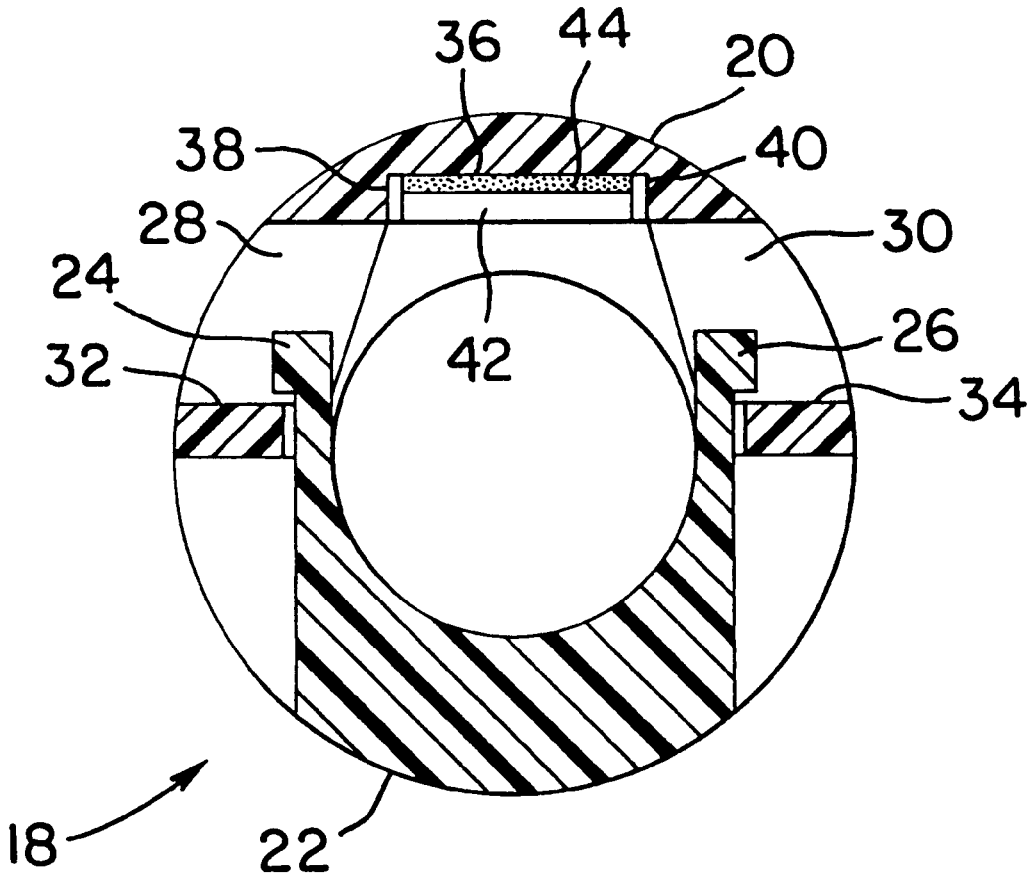
FIG. 3 is a sectional view as would be seen from plane III—III of FIG. 1.

Referring to FIGS. 1–3, an electrical cable assembly includes cable 10 terminated by plug 12 having customary prongs 14 and 16. Assembled with cable 10 is article surveillance unit 18. Unit 18 is comprised of housing members 20 and 22, secured to one another along seam line SL.

As is seen in the sectional view of FIG. 3, each of housing members 20 and 22 defines a semi-circular passage and, when the housing members are secured to one another, they jointly define a circular passage of diameter accommodating the presence of cable 10 therein. Housing member 22 includes securement members 24 and 26 projecting upwardly thereof Housing member 20 has windows 28 and 30 opening into its periphery and defines securement ledges 32 and 34 at the bottoms of the windows.

Housing member 20 defines a longitudinal recess formed therein and bounded by ceiling 36 and sidewalls 38 and 40.

In reaching the assembly of FIG. 1, EAS member 42 is secured to ceiling 36 by adhesive layer 44. Cable 10 is now disposed in the semi-circular passage of housing member 20. Housing member 22 is now arranged below housing member 20, with securement members 24 and 26 aligned with windows 28 and 30 and the housing members are now forced against one another such that securement members 24 are detentively retained by securement ledges 32 and 34.

Figure 5:
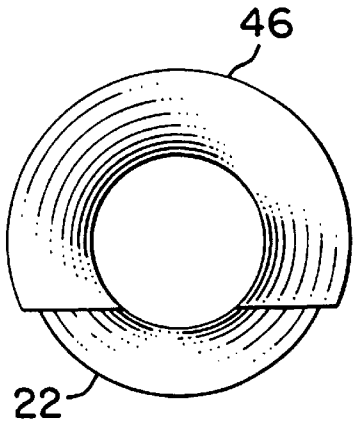
FIG. 5 is a right side elevation of FIG. 4.
Figure 4:
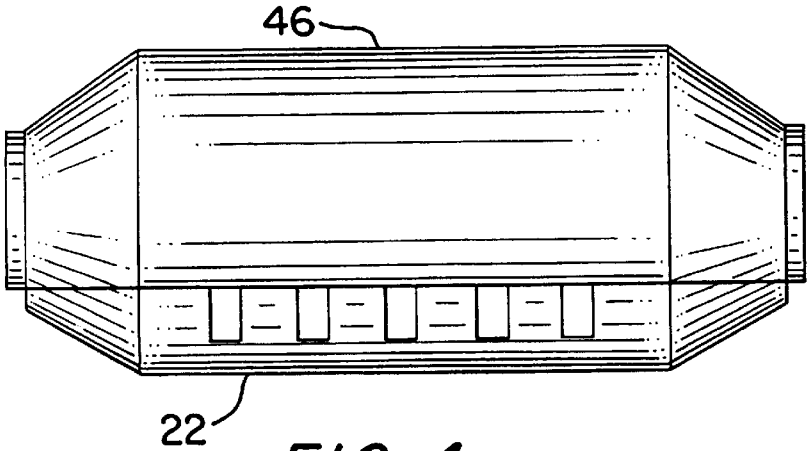
FIG. 4 is a front elevation of an electrical cable assembly and an further article surveillance unit in accordance with the invention.

Turning to FIGS. 4 and 5, the article surveillance unit shown therein includes housing member 22 of FIGS. 1–3, but has housing member 46 joined therewith. Housing member 46 differs from housing member 20 of FIGS. 1–3 in that housing member 46 has a larger outer diameter to define structure which overlaps the seam line, i.e., extend downwardly of the seam line, rendering it protected from use in separating housing members 46 and 22.

The article surveillance units discussed above offer the electrical cable assembly seller with the option of removing the unit from the cable when the article is checked out and the EAS member deactivated (FIGS. 1–3) or maintaining the unit with the cable assembly after deactivation (FIGS. 4 and 5).

Various changes to the particularly disclosed embodiments and practices may evidently be introduced without departing from the invention. For example, the cable assembly may have a cable of rectangular cross-section and the housing members may have half-rectangular passages formed therein. Accordingly, it is to be appreciated that the particularly discussed and depicted preferred embodiments and practices of the invention are intended in an illustrative and not in a limiting sense. The true spirit and scope of the invention are set forth in the ensuing claims.

What is claimed is:

1. An article surveillance unit for application to an electrical cable of a given cross-section, said electrical cable having a plug at one end thereof and one of a further plug or a connected electrical apparatus at a cable second end, said article surveillance unit comprising first and second housing parts joined to one another at least one seam line, said first and second housing parts when joined to one another defining a passage through said article surveillance unit of said given cross-section, an EAS marker being secured to an interior surface of one of said first and second housing parts adjacent said passage, said first and second housing parts when joined to one another defining respective ends of said article surveillance unit abuttable respectively with said cable plug and one of said further plug and said connected electrical apparatus.

2. The article surveillance unit claimed in claim 1, wherein each of said first and second housing parts defines a semi-circular passage therethrough.

3. The article surveillance unit claimed in claim 1, wherein each of said first and second housing parts is comprised of a plastic material.

4. The article surveillance unit claimed in claim 1, wherein said first and second housing parts define respective joinder members for securing said first and second housing parts to one another along said seam line.

5. An article surveillance unit for application to an electrical cable of a given cross-section, said electrical cable having a plug at one end thereof and one of a further plug or a connected electrical apparatus at a cable second end, said article surveillance unit comprising first and second housing members joined to one another at first and second seam lines, said first and second housing members when joined to one another defining a passage through said article surveillance-unit of said given cross-section, an EAS marker being secured to an interior surface of one of said first and second housing members adjacent said passage, said first and second housing members when joined to one another defining respective ends of said article surveillance unit abuttable respectively with said cable plug and one of said further plug and said connected electrical apparatus.

6. The article surveillance unit claimed in claim 5, wherein each of said first and second housing members defines a semi-circular passage therethrough.

7. The article surveillance unit claimed in claim 5, wherein each of said first and second housing members is comprised of a plastic material.

8. The article surveillance unit claimed in claim 5, wherein said first and second housing members define respectively joinder members for securing said first and second housing members to one another along said first and second seam lines.

9. An article surveillance unit for application to an electrical cable of a given cross-section, said electrical cable having a plug at one end thereof and one of a further plug or a connected electrical apparatus at a cable second end, said article surveillance unit comprising first and second housing members joined to one another at first and second seam lines, said first and second housing members when joined to one another defining a passage through said article surveillance unit of said given cross-section, an EAS marker being secured to an interior surface of one of said first and second housing members adjacent said passage, said first and second housing members when joined to one another defining respective ends of said article surveillance unit abuttable respectively with said cable plug and one of said further plug and said connected electrical apparatus, one of said first and second housing members having structure overlapping said first and second seam lines.

10. The article surveillance unit claimed in claim 9, wherein each of said first and second housing members defines a semi-circular passage therethrough.

11. The article surveillance unit claimed in claim 9, wherein each of said first and second housing members is comprised of a plastic material.

12. The article surveillance unit claimed in claim 9, wherein said first and second housing members define respective joinder members for securing said first and second housing members to one another along said first and second seam lines.

* * * * *

UNITED STATES PATENT AND TRADEMARK OFFICE

CERTIFICATE OF CORRECTION

PATENT NO. : 6,589,067 B1
DATED : July 8, 2003
INVENTOR(S) : Chester Kolton et al.

It is certified that error appears in the above-identified patent and that said Letters Patent is hereby corrected as shown below:

Column 1,
Line 26, delete “5,998,462” and insert -- 5,988,462 --.

Column 3,
Line 12, delete “another at least one” and insert -- another at at least one --.

Signed and Sealed this

Tenth Day of August, 2004

JON W. DUDAS
*Acting Director of the United States Patent and Trademark Office*